United States Patent [19]

Kushida et al.

[11] Patent Number: 4,564,534

[45] Date of Patent: Jan. 14, 1986

[54] HEAT-SENSITIVE TRANSFER MATERIAL AND HEAT-SENSITIVE TRANSFER RECORDING METHOD

[75] Inventors: Naoki Kushida, Yokohama; Tomoko Kusumoto, Tokyo, both of Japan

[73] Assignee: Canon Kabushiki Kaisha, Tokyo, Japan

[21] Appl. No.: 631,646

[22] Filed: Jul. 17, 1984

[30] Foreign Application Priority Data

| | | | |
|---|---|---|---|
| Jul. 23, 1983 | [JP] | Japan | 58-133586 |
| Jul. 23, 1983 | [JP] | Japan | 58-133587 |
| Jul. 23, 1983 | [JP] | Japan | 58-133588 |
| Jul. 23, 1983 | [JP] | Japan | 58-133589 |

[51] Int. Cl.[4] ..... B41M 5/26

[52] U.S. Cl. ..... 427/256; 427/288; 428/207; 428/321.5; 428/488.1; 428/488.4; 428/900; 428/913; 428/914

[58] Field of Search ..... 428/321.5, 488.1, 913, 428/914, 195, 204, 207, 320.2–321.3, 323, 403, 488.4, 900

[56] References Cited

U.S. PATENT DOCUMENTS 3,317,433 5/1967 Eichel ..... 428/321.5

*Primary Examiner*—Bruce H. Hess

*Attorney, Agent, or Firm*—Fitzpatrick, Cella, Harper & Scinto

[57] ABSTRACT

A heat-sensitive transfer material having a heat-transferable ink layer formed on a support. Said heat-transferable ink layer is constituted of micro-capsules dispersed in a heat-fusible binder and enclosing a penetrating ink. Said penetrating ink is constituted of a colorant and an oil agent which is liquid or semi-solid at room temperature. During recording, the ink released from the microcapsules will penetrate into the fibrous structure of the recording paper to give printed letters of good quality even on a recording paper with poor surface smoothness.

12 Claims, 4 Drawing Figures

HEAT-SENSITIVE TRANSFER MATERIAL AND HEAT-SENSITIVE TRANSFER RECORDING METHOD

BACKGROUND OF THE INVENTION

This invention relates to a heat-sensitive transfer material which can give a transfer-recorded image of good printed letter quality even on a recording medium with poor surface smoothness, and to a heat-sensitive transfer recording method using the same.

With rapid progress of information industries in recent years, various information processing systems have been developed, and various recording methods and devices suited for the respective information processing systems have been developed and adopted. As one of such recording methods, the heat-sensitive recording method has recently been widely used because of various advantages such as that the apparatus therefor is light in weight and compact, does not generate noise and also is excellent in operability and maintenance.

However, of the recording papers used for the heat-sensitive recording method, ordinary heat-sensitive recording papers are expensive since they are converted papers containing a color forming agent and a developing agent, and also involve the problems that alteration of the recording is possible, that the recording paper is susceptible to color formation by heat or organic solvents and that the storability of recording is poor, since a recorded image fades within a relatively short time.

As the method which maintains the advantages of the heat-sensitive recording method as described above and also compensates for the disadvantages of using heat-sensitive recording papers, the heat-sensitive transfer recording method is particularly attracting attention in these days.

In the heat-sensitive recording method, a heat-sensitive transfer material is used, which comprises a heat-transferable ink containing a colorant dispersed in a heat-fusible binder coated by melting on a support generally in the form of a sheet and the recording is generally conducted by superposing the heat-sensitive material on a recording medium such as paper so that the heat-transferable ink layer will contact the recording medium, supplying heat from the support side of the heat-sensitive transfer material by means of a thermal head to transfer the molten ink layer to the recording medium, thereby forming a transferred ink image corresponding to the heat supplying pattern on the recording medium. According to this method, the advantages of the heat-sensitive recording method as mentioned above can be maintained, and also the disadvantages with the use of the heat-sensitive recording paper can be eliminated.

However, the heat-sensitive transfer recording method of the prior art is not free from drawbacks. That is, according to the heat-sensitive transfer recording method of the prior art, the transfer recording performance, namely the printed letter quality, is remarkably influenced by the surface smoothness of the recording medium, and therefore while good printing can be effected on a recording medium having high smoothness, the printed letter quality will be markedly lowered in the case of a paper with low smoothness. However, even when paper which is the most typical recording medium may be used, a paper with high smoothness is rather special and ordinary papers have surface unevenness to various extents because they are formed through entanglements of fibers. Accordingly, in the case of a paper with large surface unevenness, the heat-molten ink cannot penetrates into fibers during printing but attaches only on the convexities or in the vicinity thereof on the surface, as a result of which the printed image may not be sharp at the edge portion or a part of the image may be missing, lowering the printed letter quality. Also, for improvement of the printed letter quality, it may be considered to use a heat-fusible binder with a low melting point. In this case, however, the heat transferable ink layer becomes tacky also at a relatively lower temperature, whereby inconveniences such as lowering in storability and staining at the non-printed portion may occur.

For the purpose of removing inconveniences such as defects or imperfections of printed letters without inviting such lowering in storability, the amount of heat supplied may be increased and heating time may be prolonged. Although imperfection of printed letters may be avoided by employment of such measures, lowering in recording sensitivity or in heat transfer speed may be caused, and further the printed letters will contrariwise become too bold, reducing the clearness of the recorded image.

SUMMARY OF THE INVENTION

A primary object of the present invention is to provide a heat-sensitive transfer material and a heat-sensitive transfer recording method which can give printed letters of good quality not only on a recording medium having good surface smoothness but also on a recording medium having poor surface smoothness, by overcoming the drawbacks of the prior art as described above, while maintaining various heat transfer performances.

According to our study with the above object, it has been found very effective to use a heat-sensitive transfer material having a microencapsulated ink comprising a colorant and an oil agent which is liquid or semi-solid at room temperature and having a property of penetrating into fibers dispersed in a heat-meltable binder constituting the heat-transferable ink layer.

Thus, by superposing the thus formed heat-sensitive transfer material with its heat-transferable ink layer facing a recording medium and heating the heat-transferable ink layer in a desired pattern while applying a pressure by means of a platen on the backside of the recording medium, the heat-fusible binder will become molten or softened to be lowered in viscosity and the microcapsules within the heat-transferable ink layer ruptured by the pressure from the platen, whereby the heated portion of the heat-transferable ink layer will be transferred to the recording medium. Then, the transfer ink penetrates into the inner portions of the fibrous structure of the recording medium with the aid of the oil agent released by rupture of the microcapsules. As a result, it is rendered possible to prevent even a recording medium with poor surface smoothness from generations defects in the printed letter images, thus improving the quality of the printed letters.

The heat-sensitive transfer material of the invention is based on the foregoing knowledge and, more specifically, comprises a support and a heat-transferable ink layer formed on the support, said heat-transferable ink layer comprising microcapsules enclosing therein a colorant and a liquid or semi-solid oil agent dispersed in a heat-fusible binder.

The heat-sensitive transfer recording method of the present invention comprises providing the above described heat-sensitive transfer material, superposing said heat-sensitive transfer material on a recording medium with its heat-transferable layer facing the recording medium and heating the heat-transferable layer of the heat-sensitive transfer material in a desired pattern to leave the image of the heat-transferable ink corresponding to the heated pattern on the recording medium after separation of the recording medium and the heat-sensitive transfer material.

According to a preferred embodiment of the present invention, magnetic powder and/or foaming agent are contained in the heat-transferable layer preferably with at least the magnetic powder being encapsulated together with the oil agent.

The present invention is described in more detail below by referring to the drawings, as desired. The quantitative proportions expressed in "%" and "parts" in the following description are by weight, unless otherwise specifically noted.

DETAILED DESCRIPTION OF THE INVENTION

Figure 1:
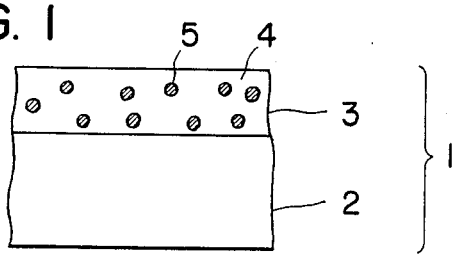
FIGS. 1 to 3 respectively show schematic sectional views in the thickness direction of embodiments of the heat-sensitive transfer material of the present invention.

FIG. 1 is a schematic sectional view in the thickness direction of the most basic embodiment of the heat-sensitive transfer material of the present invention. More specifically, the heat-sensitive transfer material 1 generally comprises a heat-transferable ink layer 3 formed on the support 2 in the form of a sheet (sheet being used to include films).

As the support 2, it is possible to use films or papers known in the art as such. For example, films of plastics having relatively good heat resistance such as polyester, polycarbonate, triacetylcellulose, nylon, polyimide, etc., Cellophane or parchment paper can preferably be used. The support should have a thickness desirably of about 2 to 15 microns when considering a thermal head as the heating source during heat transfer, but it is not particularly limited when using a heating source capable of selectively heating the heat-transferable ink layer, such as a laser beam. Also, in the case of using a thermal head, the surface of the support contacting the thermal head can be provided with a heat-resistant protective layer comprising a silicone resin, a fluorine-containing resin, a polyimide resin, an epoxy resin, a phenol resin, a melamine resin or nitrocellulose to improve the heat resistance of the support. Further, a support material which could not be used heretofore can also be used.

The heat-transferable ink layer 3 comprises microcapsules 5 enclosing a colorant and an oil agent dispersed in a heat-fusible binder 4.

The heat-fusible binders may include waxes such as carnauba wax, paraffin wax, sazol wax, microcrystalline wax, castor wax and the like; higher fatty acids or derivatives thereof, for example, metal salts or esters thereof including stearic acid, palmitic acid, lauric acid, aluminum stearate, lead stearate, barium stearate, zinc stearate, zinc palmitate, methylhydroxystearate, glycerol monohydroxystearate and the like; thermoplastic resins comprising homopolymers or copolymers of olefins or their derivatives such as polyethylene, polypropylene, polyisobutylene, polyethylene wax, polyethylene oxide, polytetrafluoroethylene, ethylene-acrylic acid copolymer, ethyleneethyl acrylate copolymer, ethylene-vinyl acetate copolymer and the like. These heat-fusible binders may be used either singly or in a mixture of two or more kinds.

The colorants may include all of various pigments and dyes employed in the field of printing and recording, for example, Carbon Black, Nigrosine dyes, Lamp Black, Sudan Black SM, Alkali Blue, Fast Yellow G, Benzidine Yellow, Pigment Yellow, Indofast Orange, Irgadine Red, Paranitroaniline Red, Toluidine Red, Cermine FB, Permanent Bordeaux FRR, Pigment Orange R, Resol Red 2G, Lake Red C, Rhodamine FB, Rhodamine B Lake, Methyl Violet B Lake, Phthalocyanine Blue, Pigment Blue, Brilliant Green B, Phthalocyanine Green, Oil Yellow GG, Zapon Fast Yellow CGG, Kayaset Y963, Kayaset TG, Sumiplast Yellow GG, Zaponfast Orange RR, Oil Scarlet, Sumiplast Orange G, Orazole Brown B, Zaponfast Scarlet CG, Aizenspiron Red BEH, Oil Pink OP, Victoria Blue F4R, Fastogen Blue 5007, Sudan Blue, Oil Peacock Blue, etc. Also, magnetic powder as described hereinafter is also useful as a colorant.

The oil agent to be used in the present invention is liquid at room temperature or semi-solid having a softening point or a melting point of 60° C. or lower. Typical examples of such oil agents may include animal or vegetable oils such as cottonseed oil, rapeseed oil, camellia oil, castor oil, peanut oil, lanolin, tallow, lard, whale oil, etc., mineral oils such as motor oil, spindle oil, dynamo oil, etc., petrolatum, glycerine, polyethylene glycol, dioctyl phthalate, monoolein, sorbitane trioleate, etc. In addition, waxes, higher fatty acids or their derivatives such as metal salts, esters, etc., and thermoplastic resins are also available, provided that they satisfy the above conditions.

For obtaining the microcapsules enclosing the colorant and the oil agent, it is possible to employ the conventionally used methods for microencapsulation, such as the method in which a mixture of the colorant and the oil agent is dispersed in a solution of a wall-forming resin and the dispersion is spray dried, or the phase separation method, the complex coacervation method, the interfacial polymerization method, etc. The wall-forming resins to be utilized may be any of the thermoplastic resins or thermosetting resins known in the art suitable for these microencapsulation methods.

The microcapsules employed may have sizes of 0.1 to 30$\mu$, particularly preferably 0.1 to 10$\mu$. The thickness of the resin walls should preferably be within the range of from 0.1 to 0.5$\mu$. The proportions of the respective components in the microcapsules are preferably 2 to 200 parts, particularly 5 to 100 parts of the oil agent, per 10 parts of the colorant. Ten parts of such microcapsules are blended with 2 to 200 parts, preferably 5 to 100 parts of a heat-fusible binder, optionally diluted with a solvent or a dispersing medium, to obtain a coating solution, which is in turn applied by a hot melt coater or a solvent coater on the support 2, followed by drying to form the heat-transferable ink layer 3, thus providing the heat-sensitive transfer material 1 of the present invention.

In the heat-fusible binder 4 or the microcapsule 5 constituting the heat-transferable ink layer 3 as described above, it is also possible to incorporate dispersants, fillers or additional colorants.

According to a preferred embodiment of the present invention, magnetic powder and/or a foaming agent is incorporated, preferably with at least the magnetic powder being encapsulated together with the oil agent.

The magnetic material may be any of those generally known as the ferromagnetic materials, including, for example, metals of ferromagnetic elements such as iron, cobalt, nickel, manganese, etc., or alloys containing these as the main components, or oxides of these elements such as magnetite, hematite, ferrite, etc., and other compounds including these ferromagnetic elements. The magnetic powder should preferably have an average particle size of 0.05μ or above but may broadly have 0.01 to 10μ, particularly preferably 0.05 to 5μ.

Also, a magnetic fluid containing magnetic powder dispersed in an oil agent is commercially available. For example, a magnetic fluid is available from Matsumoto Yushi Seiyaku K.K. under the trade name of "Marpomagna FN-40".

The foaming agents to be employed may be thermally decomposable foaming agents or readily volatile organic liquids. The thermally decomposable foaming agent may preferably be a substance which can be chemically decomposed under heating to generate gas and also satisfies the following conditions:

(1) it can be stably dispersed or dissolved in the ink material (thus, in the present specification, the "dispersed" state of the heat decomposable foaming agent in the heat-fusible binder is also inclusive of the dissolved state);

(2) it is stable at room temperature and can decompose at a temperature of 200° C. or lower;

(3) the decomposed gas is not corrosive or toxic;

(4) the decomposed gas is free from objectionable odor and contaminating properties; and (5) the agent itself and its decomposed residue do not react with the oil agent or heat-fusible binder to cause decoloration or denaturation.

For example, inorganic foaming agents satisfying these conditions include bicarbonates such as sodium bicarbonate, ammonium bicarbonate, etc.; carbonates such as ammonium carbonate, magnesium carbonate, etc.; equimolar mixture of sodium nitrite and ammonium chloride; azide compounds such as $CaN_6$ or $BaN_6$; ferrous oxalate; ammonium persulfate; sodium borohydride; and so on. Examples of organic foaming agents are azo type foaming agents such as azodicarbonamide (ADCA), azobisisobutyronitrile (AIBN), diazoaminobenzene (DAB), etc.; nitroso type foaming agents such as N,N'-dinitrosopentaethylenetetramine (DPT or DNTD), N,N'-dimethyl-N,N'-(DMDNTA), etc.; sulfonyl hydrazide type foaming agents such as p-toluenesulfonyl hydrazide (TSH), benzenesulfonyl hydrazide (BSH), p,p'-oxybisbenzenesulfonyl hydrazide, etc.

These inorganic foaming agents or organic foaming agents may be used either singly or as a mixture of two or more kinds in the same system or two or more kinds selected from both of the systems. If desired, a foaming aid may also be formulated in the foaming agent for the purpose of controlling the decomposition temperature of the foaming agent.

The foaming aid may be any compound having a function of lowering the decomposition temperature of the foaming agent employed when combined with the foaming agent, and, depending on the foaming agent used, those enumerated below may be available. For example, there may be included oxalic acid, lactic acid, citric acid, succinic acid, malic acid, benzoic acid, salicylic acid, fumaric acid, malonic acid, adipic acid, gallic acid, toluenesulfonic acid, phosphoric acid, guanidine carbonate, ethanolamine, potassium carbonate, borax, boric acid, silicid acid, cadmium oxide, zinc oxide, zinc acetate, zinc chloride, zinc nitrate, zinc laurate, zinc powder, mercury acetate, mercury oxide, barium stearate, calcium stearate, magnesium oxide, calcium carbonate, lead carbonate, lead acetate, lead oxide, lead sulfate, dibasic phosphite, stannous oxide, Dexy-clay, dimethylformamide, aluminum stearate, titanium oxide, boron trifluoride, urea and so on. When there is a possibility of generation of a small amount of formaldehyde during heat decomposition as in the case of using an organic weak acid as the foaming aid, it is preferred to employ a compound having an action to capture formaldehyde such as urea in combination.

As the readily volatile organic liquid, any of the compounds used in the field of resin processing as an evaporation type foaming agent or a readily volatile foaming agent can be used as such also in the present invention. The readily volatile organic liquid to be preferably used is generally liquid at around room temperature and normal pressure, and a compound having a boiling point of 130° C. or lower, particularly 100° C. or lower. Typical examples of the readily volatile organic liquids are set forth below:

(a) Aliphatic hydrocarbons:

For example, hydrocarbons having 4 to 7 carbon atoms such as n-propane, n-pentane, n-hexane, neopentane, isohexane, n-heptane, isoheptane and the like. These are low in toxicity and economical.

(b) Chlorinated aliphatic hydrocarbons:

For example, methyl chloride, methylene dichloride, trichloroethylene, dichloroethane (sym), and the like.

(c) Fluorinated aliphatic hydrocarbons:

For example, chlorine-fluorine derivatives of methane or ethane such as Freon-11 ($CCl_3F$), Freon-12 ($CCl_2F_2$), Freon-21 ($CHCl_2F$), Freon-22 ($CHClF_2$), Freon-113 ($CCl_2F$-$CClF_2$), Freon-114 ($CClF_2$-$CClF_2$) are frequently used.

(d) Aromatic hydrocarbons:

Benzene, toluene and the like.

The readily volatile organic liquid may be used by microencapsulating it together with the colorant and the oil agent or as separate microparticles containing it within resin microparticles by impregnation or microencapsulation. In the case of the resin impregnation method, it is possible to employ, for example, a method in which a readily volatile organic liquid is added during the process of suspension polymerization of an appropriate monomer (Japanese Patent Publication No. 3190/1958) or a method in which beads obtained by suspension polymerization are swelled with a solvent and a readily volatile organic liquid is added thereto (Japanese Patent Publication No. 10628/1961). If desired, the resin may be micropulverized before impregnation with a readily volatile organic liquid. The microencapsulation method is also inclusive of various methods such as the complex coacervation method, the interfacial polymerization method and the phase separation method known in the art. Various commercial products are available as microcapsules enclosing readily volatile organic liquid, such as Matsumoto Microsphere F30, F50 and F60 produced by Matsumoto Yushi Seiyaku K.K. or Expancell produced by Nippon Philite K.K. (enclosing a foaming agent of isobutane within a wall material of vinylidene chloride/acrylonitrile copolymer).

Including those as described above, as the microparticulate filler material containing a readily volatile organic liquid, it is preferred to use one having particle sizes of 0.1 to 30 microns, particularly 0.1 to 10 microns, above all one with smaller particle sizes.

When magnetic powder is employed, this should preferably be microencapsulated together with the oil agent to give a proportion of 2 to 200 parts, particularly 5 to 100 parts, of the oil agent per 10 parts of the magnetic powder.

The foaming agent can be microencapsulated together with the oil agent and the colorant. In this case, the amount of the foaming agent may preferably be within the range of 2 to 20 parts, particularly 2 to 10 parts, per 10 parts of the colorant (including magnetic powder). If too much foaming agent is used, the ink becomes too viscous and poor in penetration into the recording medium, while too little foaming agent fails to produce an effect.

Figure 2:
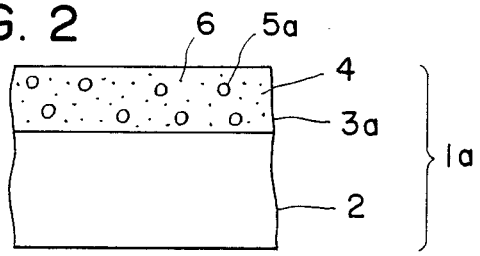

Alternatively, the foaming agent may also be dispersed in the heat-fusible binder separately from the microcapsules enclosing the oil agent and the colorant. FIG. 2 shows a schematic sectional view in the thickness direction of a heat-sensitive transfer material 1*a* according to this embodiment. In this embodiment, the heat-transferable ink layer 3*a* comprises microcapsules 5*a* enclosing the oil agent and the colorant (including magnetic material) and a foaming agent 6 dispersed therein. The respective components 3*a* constituting the heat-transferable ink layer may be similar to those described in the embodiment shown in FIG. 1. When employing a readily volatile organic liquid as the foaming agent, this should preferably be incorporated in the resin by impregnation as described above or dispersed in the heat-fusible binder 4 as the microparticulate filler enclosed by microencapsulation. In this embodiment, it is preferred to formulate 2 to 200 parts, particularly 5 to 100 parts of the oil agent per 10 parts of the colorant in the microcapsule 5*a*, and 2 to 30 parts, particularly 2 to 20 parts of the foaming agent, 2 to 100 parts, particularly 5 to 50 parts of the heat-fusible binder, per 10 parts of the microcapsule.

Figure 3:
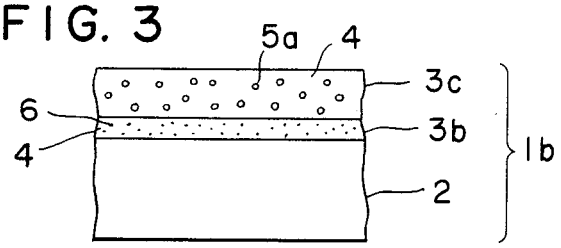

Also, as an embodiment related to FIG. 2, the heat-transferable ink layer can be divided into the layer 3*b* containing the blowing agent 6 and the layer 3*c* containing the microcapsule 5*a* enclosing the colorant (including magnetic powder) and the oil agent, as shown in FIG. 3. The proportions of the respective components in this case are substantially the same as those in the case of FIG. 2.

In any of the above cases of FIG. 1 to FIG. 3, additives such as dispersants, fillers, etc. may also be added in the heat-fusible binder 4 or the microcapsule 5 or 5*a* constituting the heat-transferable ink layer, as desired. Also, for increasing the color density of the heat-transferable ink layer or controlling its tone, an additional colorant may be added into the heat-fusible binder 4.

The heat-sensitive transfer material of the present invention generally has a planar shape which is not particularly limited, but it is generally shaped in a typewriter ribbon or a tape with a large width as used in line printers, etc. Also, for the purpose of color recording, it can be made a heat-sensitive transfer material in which heat-fusible ink is coated into several kinds of color tones in stripes or blocks.

Figure 4:
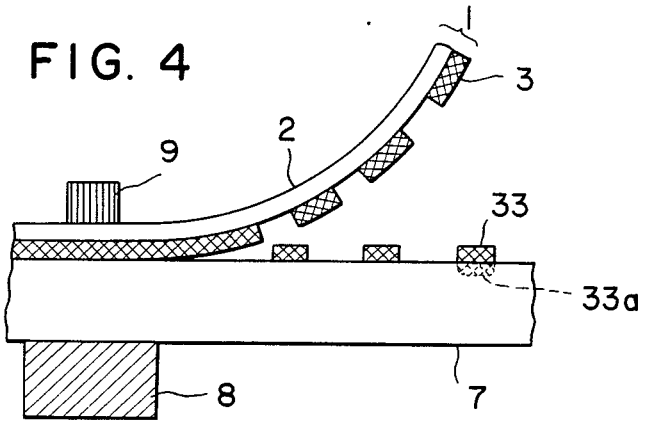
FIG. 4 is a schematic sectional view as seen in the thickness direction of a heat-sensitive transfer material for illustration of an embodiment of the heat-sensitive transfer recording method by use of the heat-sensitive transfer material shown in FIG. 1.

Next, the heat-sensitive transfer recording method employing the above heat-sensitive transfer material is described by referring to the case in which a thermal head is employed as the most typical heat source. FIG. 4 is a schematic sectional view in the thickness direction of the heat-sensitive transfer material showing its outline. More specifically, the heat-fusible ink 3 of the heat-sensitive transfer material 1 is caused to closely contact the recording medium, and while being given a heat pulse by means of the thermal head 8 with an additional heat pulse, if desired, from the platen 7, the ink layer 3 is heated locally in correspondence to the desired printed letter or the transfer pattern. The portion to be heated of the ink layer 3 will be softened or melted on reaching a certain temperature and will abruptly become lower in viscosity. As the result, the microcapsules are ruptured by the pressure from the platen, and the penetrating ink enclosed therein is transferred together with the softened or melted binder onto the recording medium 6. After transfer, the penetrating ink released from the capsules can penetrate through the penetrating force of the oil agent even into the inner portions of the fibrous structure of the recording medium where no heat transfer ink of the prior art could penetrate, thus giving a recorded image 33 of good printed letter quality, having the penetrated and filled portion 33*a* without defect of the printed letter image, even on the recording medium of poor surface smoothness.

In this case, when a foaming agent is contained in the heat-transferable ink layer either in the form of being microencapsulated (FIG. 1) or being directly dispersed in the heat-fusible binder of the ink layer 3*a* or 3*b* (FIG. 2 or FIG. 3), the gas pressure generated by decomposition or gasification of the blowing agent dispersed just before or after softening or melting of the ink layer 3 (or 3*a* or 3*b*) at the heated portion will promote breakage of the microcapsules and also adhesion of the ink onto the surface concavities of the recording medium 7. By such mechanism, the penetration of the attached ink into the inner portions of the fibrous structure of the recording medium through the penetrating force of the oil agent can be enhanced effectively.

On the other hand, when magnetic powder is contained in the heat-transferable ink layer 3 by microencapsulation together with the oil agent, by use of, for example, a platen 8 having a built-in permanent magnet, magnetic attracting force is permitted to act on the magnetic ink released from the microcapsules from the heat-sensitive transfer material to the recording medium 7, whereby attachment of the ink onto the surface concavities of the recording medium 7 can be promoted. Thus, similarly, the penetration of the attached ink into the inner portions of the fibrous structure of the recording medium through the penetrating force of the oil agent can be enhanced effectively.

For applying magnetic attractng force on the heat-sensitive transfer material 1, toward the recording medium 7, any desired magnetic field generating means other than a permanent magnet may be used. The strength of the magnetic field is not particularly limited, but it is generally 400 Oersted or higher.

As described in detail above, according to the present invention, there is provided a heat-sensitive transfer material in which colorant and oil agent are dispersed after microencapsulation thereof in a heat-transferable ink layer, and, by using the transfer material, it has been rendered possible to effect recording with a good quality of printed letters even on a recording medium with poor surface smoothness while maintaining various good heat transfer performances, including storability of the heat transfer material. Also, when a foaming agent and/or magneitc powder are used in combination, adhesiveness of the magnetic ink to the recording medium can be improved to further promote penetration of the ink.

The present invention is described below by referring to the following Examples and Comparative examples.

EXAMPLE 1

Ten parts of carbon black, 25 parts of castor oil and 5 parts of lecithin were kneaded by means of a three-roll mill to obtain a penetrating ink. One hundred grams of this ink were emulsified in 400 g of an aqueous 2% gelatin solution by means of a homomixer at 8000 rpm to obtain an emulsion with particle sizes of 1 to 2 μm. This dispersion was adjusted to pH 8–9 with an aqueous 10% sodium carbonate solution and 50 g of a urea-formalin prepolymer was added under the condition of a liquid temperature of 25° C. under stirring, followed by adjustment of pH to 4 with acetic acid. Subsequently, the above emulsion was heated under stirring and maintained at 30° C. for 3 hours and at 50° C. for 2 hours to obtain a microcapsule dispersion having urea-formalin resin walls enclosing penetrating ink particles. The dispersion was cooled and filtered to obtain microcapsules of 1 to 2 μm enclosing penetrating ink therein.

One part of polyethylene wax (softening point: about 95° C.), 2 parts of paraffin wax (softening point: about 70° C.) and one part of carnauba wax were mixed by heating at 100° C. under stirring. Then, 16 parts of a petroleum solvent (trade name: Isopar H, produced by Esso) were added to the mixture, and the mixture was heated at about 100° C. and thereafter cooled under vigorous stirring to room temperature to obtain a fine dispersion of wax.

A coating solution obtained by mixing under stirring 20 parts of the above fine dispersion of wax with 4 parts of the microcapsules was applied on a polyester film with a thickness of 6 μm and dried to obtain a heat-sensitive transfer material having a transfer layer with a thickness of 10 μm.

EXAMPLE 2

| | |
|---|---|
| Carbon Black | 10 parts |
| Hexane | 5 parts |
| Rapeseed oil | 20 parts |
| Methyl methacrylate | 90 parts |
| Acrylonitrile | 10 parts |
| Divinylbenzene | 0.025 part |
| Hydrophobic amine | 0.5 part |
| (Duomine-T, produced by Lion-Armor K.K.) | |
| Benzoyl peroxide | 0.2 part |

The above components were mixed and dispersed homogeneously to obtain an oily mixture.

| | |
|---|---|
| Deionized water | 100 parts |
| Hydrophilic silica | 3 parts |
| (A-300, produced by Nippon Aerosil K.K.) | |
| Potassium bichromate | 0.025 part |

An aqueous solution having the above composition was adjusted to pH 4 and the above oily mixture was emulsified into this aqueous solution by means of a homo-mixer at 12,000 rpm, and thereafter the reactor was immediately sealed and the reaction was carried out at 80° C. for 24 hours. After completion of the reaction, the reaction product was filtered and the solids were dried at 30° C. to obtain microcapsules of 1–2μ in which the oily material was encapsulated with a ternary copolymer of methyl methacrylate, acrylonitrile and divinylbenzene.

A coating solution obtained by mixing under stirring 20 parts of the fine dispersion of wax employed in Example 1 and 4 parts of the above microcapsules was applied on a polyester film with a thickness of 6μ and dried to obtain a heat-sensitive transfer material having a heat-transferable ink layer with a thickness of 10 μm.

EXAMPLE 3

A mixture of 15 parts of ferrite, 25 parts of castor oil and 5 parts of lecithin was kneaded on a three-roll mill to obtain a penetrating ink. This mixture and 0.4 g of terephthalic chloride were added into 400 ml of an aqueous 0.5% sodium bicarbonate solution and emulsified by means of a homo-mixer to oil droplet sizes of 1 to 2μ. Further, while stirring was continued, 100 ml of an aqueous 10% ethylene glycol solution was added and stirring was continued for 10 minutes. Then, the dispersion was spray dried by means of a spray dryer to obtain powdery microcapsules enclosing the penetrating ink within polyester walls.

To 20 parts of the fine dispersion of wax obtained in Example 1 were added 4 parts of the above microcapsules and 2 parts of microcapsules enclosing readily volatile organic liquid (Microsphere F produced by Matsumoto Yushi K.K.), followed by mixing under stirring, to obtain a coating solution. The coating solution was applied on a polyester film with a thickness of 6μ similarly as in Example 1 to obtain a heat-sensitive transfer material having a heat-transferable ink layer with a thickness of 10μ.

EXAMPLE 4

A mixture of 10 parts of carbon black, 25 parts of cottonseed oil, 5 parts of lecithin and 4 parts of ammonium carbonate was kneaded on a three-roll mill to obtain a penetrating ink. By use of this penetrating ink in place of the penetrating ink of Example 3, microcapsules were obtained according to the procedure of Example 3.

To 20 parts of the fine dispersion of wax obtained in Example 1 were added 4 parts of the above microcapsules, followed by mixing under stirring, to obtain a coating solution. This coating solution was applied on a polyester film with a thickness of 6μ similarly as in Example 1 to obtain a heat-sensitive transfer material having a heat-transferable ink layer with a thickness of 10μ.

EXAMPLE 5

Example 4 was repeated except for changing ammonium carbonate to calcium azide to obtain a heat-sensitive transfer material.

EXAMPLE 6

By use of a penetrating ink comprising 10 parts of carbon black, 25 parts of lanolin, 5 parts of lecithin, 4 parts of azodicarbonamide and 0.2 part of ethanolamine, a heat-sensitive transfer material was obtained similarly as in Example 4.

EXAMPLE 7

A mixture of 15 parts of ferrite, 25 parts of repeseed oil and 5 parts of lecithin was kneaded on a three-roll mill to obtain a penetrating ink. By using this penetrating oil in place of the penetrating ink of Example 1, microcapsules were obtained following the procedure of Example 1.

Then, by use of the microcapsules, a heat-sensitive transfer material was obtained similarly as in Example 1.

EXAMPLE 8

Example 2 was repeated except for using 10 parts of ferrite in place of 10 parts of carbon black to obtain a heat-sensitive transfer material.

EXAMPLE 9

Fifteen parts of ferrite, 25 parts of rapeseed oil and 5 parts of lecithin were kneaded by means of a three-roll mill to obtain a penetrating ink. One hundred grams of this ink were emulsified in 400 g of an aqueous 2% gelatin solution by means of a homomixer at 800 rpm to obtain an emulsion with particle sizes of 1 to 2 μm. This dispersion was adjusted to pH 8–9 with an aqueous 10% sodium carbonate solution and 50 g of a urea-formalin prepolymer was added under the condition of a liquid temperature of 25° C. under stirring, followed by adjustment of pH to 4 with acetic acid. Subsequently, the above emulsion was heated under stirring and maintained at 30° C. for 3 hours and at 50° C. for 2 hours to obtain a microcapsule dispersion having urea-formalin resin walls penetratable ink particles. The dispersion was cooled and filtered to obtain microcapsules of 1 to 2μ enclosing the penetrating ink therein.

To 20 parts of the fine dispersion of wax obtained in Example 1 were added 4 parts of the above microcapsules and 2 parts of microcapsules enclosing readily volatile organic liquid (Microsphere F produced by Matsumoto Yushi K.K.), followed by mixing under stirring, to obtain a coating solution. The coating solution was applied on a polyester film with a thickness of 6μ similarly as in Example 1 to obtain a heat-sensitive transfer material having a heat-transferable ink layer with a thickness of 10μ.

EXAMPLE 10

A mixture of 10 parts of ferrite, 25 parts of rapeseed oil, 5 parts of lecithin and 4 parts of ammonium carbonate was kneaded on a three-roll mill to obtain a penetrating ink. By use of this penetrating ink in place of the penetrating ink of Example 9, microcapsules were obtained according to the procedure of Example 9.

To 20 parts of the fine dispersion of wax obtained in Example 1 were added 4 parts of the above microcapsules, followed by mixing under stirring, to obtain a coating solution. This coating solution was applied on a polyester film with a thickness of 6μ similarly as in Example 1 to obtain a heat-sensitive transfer material having a heat-transferable ink layer with a thickness of 10μ.

EXAMPLE 11

Example 10 was repeated except for changing ammonium carbonate to calcium azide to obtain a heat-sensitive transfer material.

EXAMPLE 12

By use of a penetratable ink comprising 10 parts of ferrite, 25 parts of lanolin, 5 parts of lecithin, 4 parts of azodicarbonamide and 0.2 part of ethanolamine, a heat-sensitive transfer material was obtained similarly as in Example 10.

EXAMPLE 13

A mixture of 20 parts of a magnetic fluid (trade name: Marpomagna FN-40, produced by Matsumoto Yushi Seiyaku), 4 parts of calcium azide and 0.2 part of terephthaloyl chloride was mixed and stirred by means of a homo-mixer. The resultant mixture was emulsified into 200 ml of an aqueous 0.5% sodium bicarbonate solution to oil droplet sizes of 1–2μ. While stirring was continued, 50 ml of 10% ethylene glycol was added to the emulsion and stirring was further continued for 10 minutes. Then, the mixture was spray dried by a spray dryer to obtain microcapsule powder having polyester walls with thicknesses of 1 to 2μ.

The microcapsules of Example 10 were replaced with the above microcapsules, following otherwise the same procedure as in Example 10, to obtain a heat-sensitive transfer material.

COMPARATIVE EXAMPLE 1

A typical example of the heat-sensitive transfer material of the prior art was prepared as follows. That is, one part of carbon black, one part of polyethylene wax (softening point: about 95° C.), 2 parts of paraffin wax (softening point: about 70° C.) and one part of carnauba wax were mixed and dispersed by means of an attritor by heating at about 100° C. Then, 30 parts of a petroleum solvent (trade name: Isopar, produced by Esso) were added to the mixture, and heated to about 100° C., followed by cooling to room temperature under vigorous stirring, to obtain an Isopar H solution containing carbon black/wax finely dispersed therein.

The above dispersion was applied on a polyester film with a thickness of 6 μm and dried to obtain a heat-sensitive transfer material with a transfer ink layer of 10 μm.

By use of the various kinds of heat-sensitive transfer materials, recording was effected on three kinds of recording paper (bond paper with Bekk smoothness of 15 sec., wood free papers with Bekk smoothness of 30 sec. and 100 sec.) according to a heat-sensitive transfer-type facsimile machine which operates according to the mechanism as substantially described with regard to FIG. 4, and their resolutions were evaluated. For Examples 7–13, recording was performed while permitting a magnetic field of 1200 Oersted to act on the laminated portion of the recording paper by the permanent magnet built in the platen 8.

In the comparison example, the best value of resolution obtained by use of an electrophotographic chart as the original was 6.3 lines/mm for the wood free paper with Bekk smoothness of 100 sec., which value being decreased as 4.5 lines/mm for the high quality paper of 30 sec. and 3.6 lines/mm for the bonded paper of 15 sec. In contrast, by use of the heat-sensitive transfer materials of the present invention of Examples 1 through 13, a resolution of 6.3 lines/mm could be obtained for wood free paper of 30 sec. and 5.6 lines/mm even for bonded paper of 15 sec.

As apparently seen from the above results, when using the heat-sensitive transfer material of the present invention, lowering in resolution is very little even when the smoothness of the paper may be lowered. The recorded image by the heat-sensitive transfer material obtained in Examples 6 and 12 had a very good sharpness of recording. This may be attributable to closeness of the melting temperature of the heat-fusible ink to the decomposition temperature of the foaming agent, whereby the molten ink could be very effectively transferred.

What is claimed is:

1. A heat-sensitive transfer material comprising a support and a heat-transferable ink layer formed on said support, said heat-transferable ink layer comprising a colorant, an oil agent which is liquid or semi-solid at room temperature, a foaming agent and a heat-fusible binder, said colorant and oil agent being microencapsulated, and said foaming agent and the micro-capsules enclosing said colorant and oil agent being respectively dispersed within said heat-fusible binder.

2. A heat-sensitive transfer material according to claim 1, wherein the oil agent has a melting point or a softening point of 60° C. or lower.

3. A heat-sensitive transfer material according to claim 1, wherein the colorant comprises magnetic powder.

4. A heat-sensitive transfer material according to claim 1, wherein the foaming agent is a thermally decomposable foaming agent.

5. A heat-sensitive transfer material according to claim 1, wherein the foaming agent is a readily volatile organic liquid held in the heat-transferable layer by being microencapsulated or impregnating resin particles.

6. A heat-sensitive transfer material according to claim 1, wherein the foaming agent is enclosed within said microcapsules.

7. A heat-sensitiv transfer material according to claim 1, wherein the foaming agent is dispersed together with said microcapsules within the heat-fusible binder.

8. A heat-sensitive transfer material according to claim 1, wherein the heat-transferable ink layer is formed in a laminated structure comprising a first ink layer containing the foaming agent dispersed in the heat-fusible binder and a second ink layer containing microcapsules enclosing the colorant and the oil agent within the heat-fusible binder, provided in the order named from the support side.

9. A heat-sensitive transfer material, comprising a support and a heat-transferable ink layer formed on said support, said heat-transferable ink layer comprising magnetic powder, an oil agent which is liquid or semi-solid at room temperature, a foaming agent and a heat-fusible binder, said magnetic powder and oil agent being microencapsulated, and said foaming agent and the microcapsules enclosing the magnetic powder and oil agent being respectively dispersed in said heat-fusible binder.

10. A heat-sensitive transfer recording method, which comprises:

providing a heat-sensitive transfer material and a heat-transferable ink layer formed on a support, the heat-transferable ink layer comprising a heat-fusible binder, microcapsules dispersed in a heat-fusible binder and enclosing a colorant and an oil agent which is liquid or semi-solid at room temperature, and a foaming agent dispersed in the heat-fusible binder, superposing the heat-sensitive transfer material on a recording medium with its heat-transferable layer facing the recording medium, and heating the heat-transferable layer of the heat-sensitive transfer material in a desired pattern to leave the image of the heat-transferable ink corresponding to the desired pattern on the recording medium after separation of the recording medium and the heat-sensitive transfer material.

11. A heat-sensitive transfer recording method according to claim 10, wherein the oil agent has a melting point or a softening point of 60° C. or lower.

12. A heat-sensitive transfer recording method according to claim 10, wherein the colorant comprises magnetic powder and the pattern heating of the heat transfer layer is effected under the action of a magnetic attracting force directed from the heat-sensitive transfer material toward the recording medium.

* * * * *